US006976617B2

(12) United States Patent
Shore et al.

(10) Patent No.: US 6,976,617 B2
(45) Date of Patent: Dec. 20, 2005

(54) UNINTERRUPTED CONTINUOUS ROLLING OF BAR AND ROD PRODUCTS

(75) Inventors: T. Michael Shore, Princeton, MA (US); Melicher Puchovsky, Dudley, MA (US)

(73) Assignee: Morgan Construction Company, Worcester, MA (US)

( * ) Notice: Subject to any disclaimer, the term of this patent is extended or adjusted under 35 U.S.C. 154(b) by 50 days.

(21) Appl. No.: 10/424,503

(22) Filed: Apr. 28, 2003

(65) Prior Publication Data

US 2004/0108361 A1 Jun. 10, 2004

Related U.S. Application Data

(60) Provisional application No. 60/378,757, filed on May 8, 2002.

(51) Int. Cl.[7] ..... B23K 31/00

(52) U.S. Cl. ..... 228/173.6; 228/170

(58) Field of Search ..... 228/170, 173.5–173.6, 228/158, 5.7, 160, 171, 205; 72/228, 231, 199, 155, 234

(56) References Cited

U.S. PATENT DOCUMENTS

| | | | | |
|---|---|---|---|---|
| 2,120,316 A | * | 6/1938 | Stone | 228/5.7 |
| 3,451,123 A | | 6/1969 | Fredriksson et al. | |
| 4,106,318 A | * | 8/1978 | Yanagimoto et al. | 72/199 |
| 4,294,394 A | * | 10/1981 | Iida et al. | 228/158 |
| 5,219,114 A | * | 6/1993 | Kajiwara et al. | 228/158 |
| 5,767,475 A | | 6/1998 | Takashima | |
| 5,931,370 A | * | 8/1999 | Poloni et al. | 228/158 |
| 6,089,441 A | | 7/2000 | Matsuo et al. | |
| 6,216,515 B1 | | 4/2001 | Grimmel et al. | |
| 6,538,228 B2 | * | 3/2003 | Lara et al. | 219/104 |
| 2001/0015367 A1 | | 8/2001 | Matsuo et al. | |

FOREIGN PATENT DOCUMENTS

| | | |
|---|---|---|
| DE | 4323837 A1 | 1/1995 |
| RU | 371985 | 10/1970 |
| RU | 550184 | 7/1975 |

* cited by examiner

*Primary Examiner*—Jonathan Johnson
(74) *Attorney, Agent, or Firm*—Gauthier & Connors LLP

(57) ABSTRACT

Discrete billets are rolled through a plurality of roll stands arranged along a rolling mill pass line to produce successive product lengths having reduced cross sections and front and tail ends. At a selected location along the pass line, the tail end of each product length is joined to the front end of the next successive product length to thereby permit uninterrupted continuous rolling through the remainder of the mill.

11 Claims, 5 Drawing Sheets

UNINTERRUPTED CONTINUOUS ROLLING OF BAR AND ROD PRODUCTS

CROSS REFERENCE TO RELATED APPLICATION

This application claims priority of provisional application Ser. No. 60/378,757 filed May 8, 2002.

BACKGROUND OF THE INVENTION

1. Field of the Invention

This invention relates generally to the production of bar and rod products in continuous rolling mills by hot rolling discrete billets through roughing, intermediate and finishing mill sections, and is concerned in particular with a method and apparatus for the end-to-end welding of separate product lengths at a selected location along the rolling line, thereby making it possible to continue rolling uninterruptedly throughout the remainder of the mill.

2. Description of the Prior Art

In conventional bar and rod rolling mills currently in operation, the accepted practice is to begin the process with individual billets that are heated in a furnace and then discharged for separate rolling into product lengths having reduced cross sectional areas and front and tail ends. A number of drawbacks are associated with this practice. For example, the gap time between billets can account for as much as 10% lost production time.

Also, the front and tail ends of each product length are dimensionally and/or metallurgically unacceptable and must therefore be trimmed and discarded, resulting in considerable scrap losses. The front ends are also prone to cobbling, particularly at the higher speeds reached in the finishing section of the mill.

In an effort at avoiding these problems, technology has been developed to weld the billets end-to-end before they are introduced in the mill. However, this too has proven to be somewhat problematical. Welding of the large billet cross sections requires massive equipment and a heavy consumption of electrical energy. Excessive electrical energy is additionally required to inductively reheat the billet segments that have been chilled by contact with the heavy clamping devices required to force the billet ends together.

A further drawback with billet welding stems from the fact that the fused metal at the welded joint is subsequently rolled into a substantial length of the finished product. For example, when billets having a typical cross sectional area of 22,500 $mm^2$ are welded and then rolled into 5.5 mm rod, the fused metal of the welded joint will extend through approximately 94 meters of the finished product. If the billets are metallurgically dissimilar, this length may well have to be scrapped, at a considerable loss to the mill operator.

The present invention applies welding technology to the rolling process in a manner and at a location along the rolling line that avoids or at least significantly minimizes the problems and disadvantages associated with current practices.

DETAILED DESCRIPTION OF PREFERRED EMBODIMENTS

Figure 1:
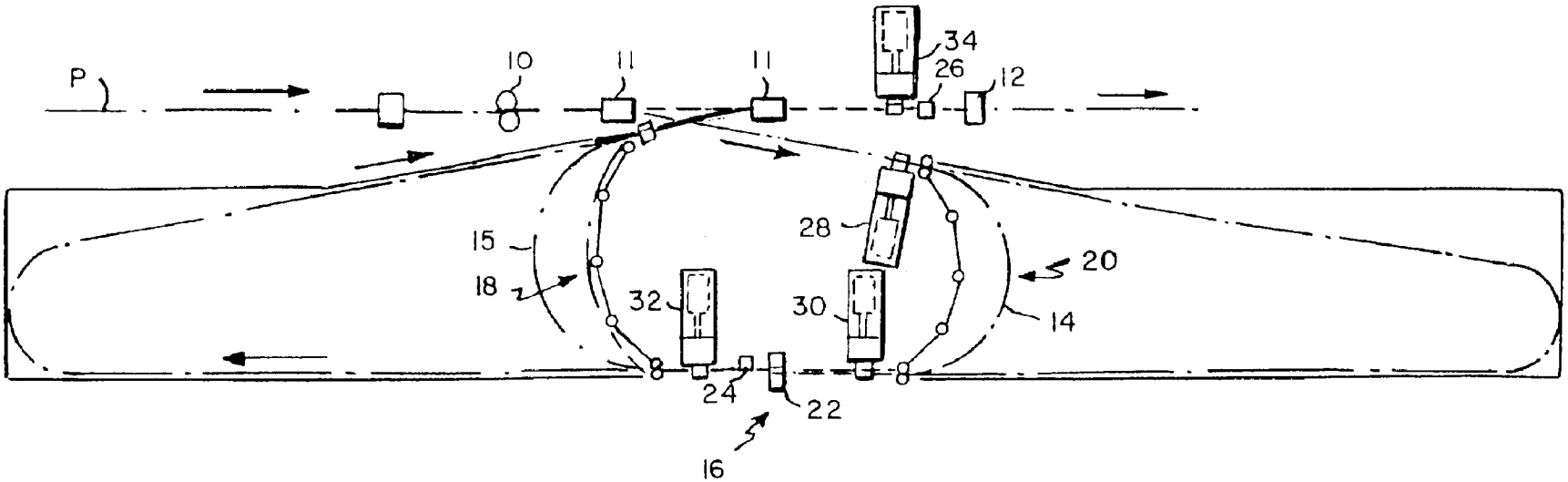
FIG. 1 is a plan view of one embodiment of an apparatus in accordance with the present invention.
Figure 2A:
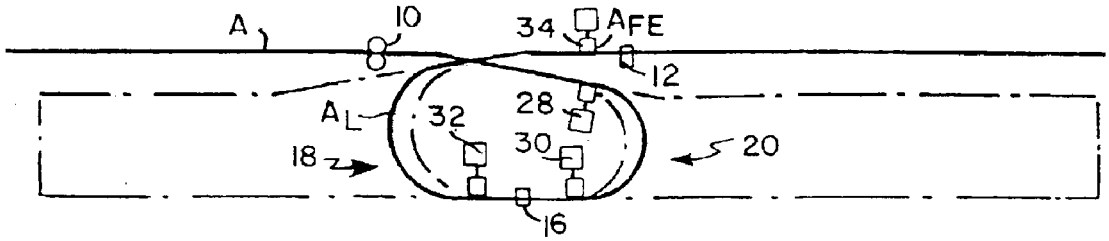
FIGS. 2A–2J are diagrammatic views showing successive stages in the operation of the apparatus depicted in FIG. 1.
Figure 2B:
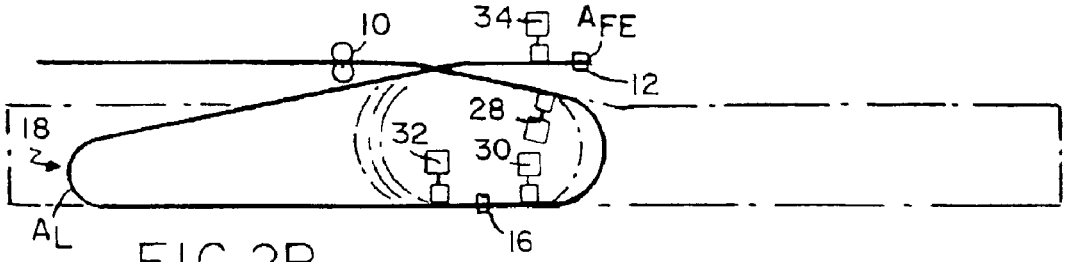
Figure 2C:
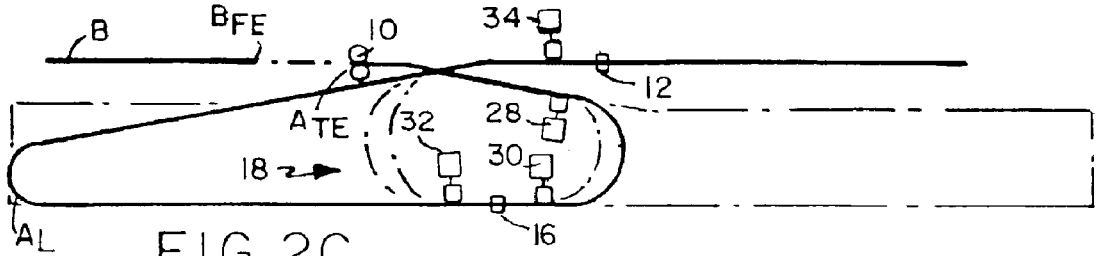
Figure 2D:
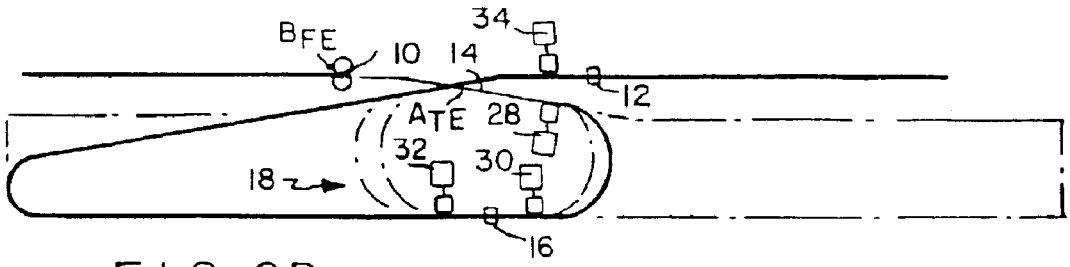
Figure 2E:
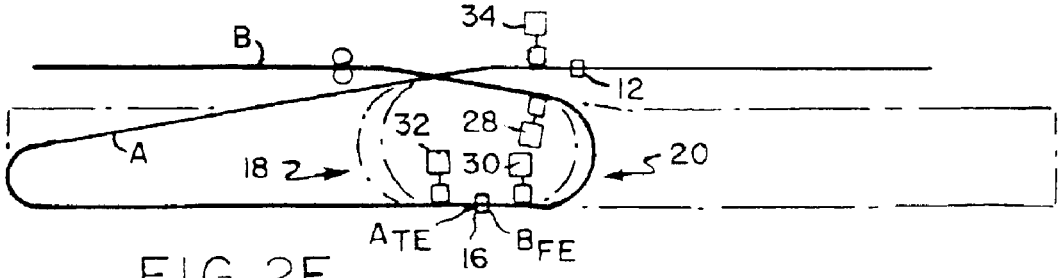
Figure 2F:
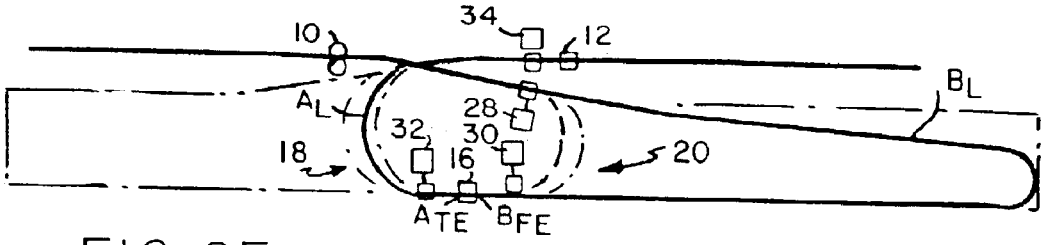
Figure 2G:
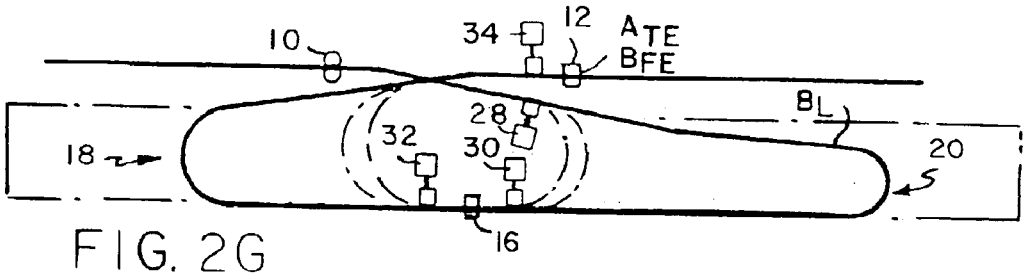
Figure 2H:
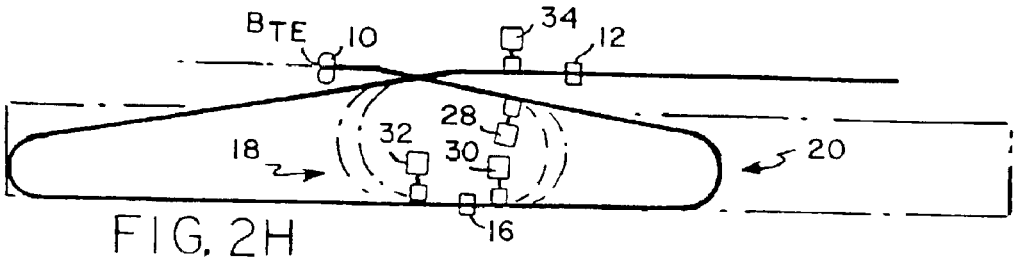
Figure 2I:
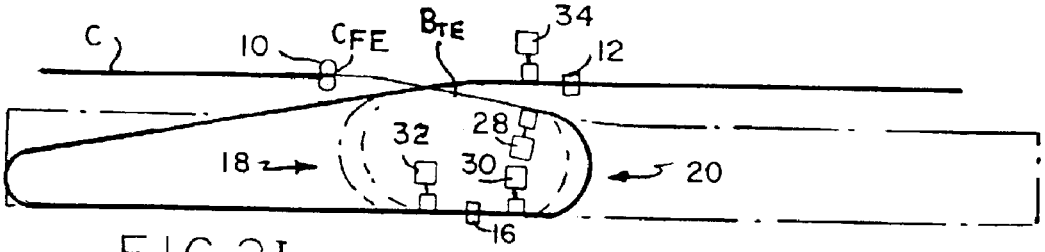
Figure 2J:
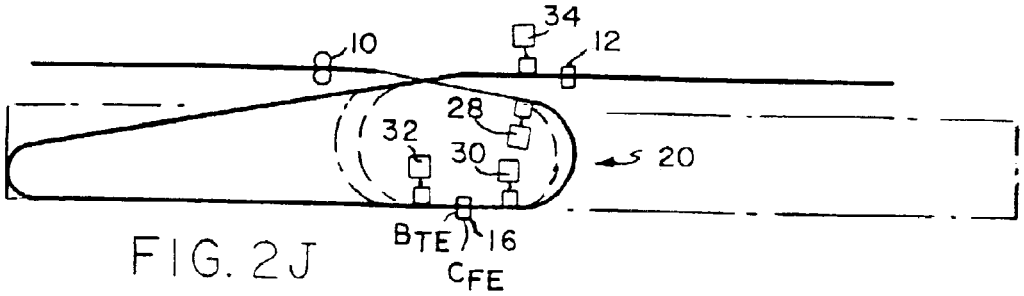

With reference initially to FIG. 1, first and second vertical and horizontal roll stands 10 and 12 are shown positioned along a mill pass line "P". Roll stand 10 may, for example comprise the last roll stand of the mill's roughing section, and stand 12 may comprise the first roll stand of the mill's intermediate section. The delivery speed of roll stand 10 will exceed the take-up speed of roll stand 12. Thus, in an exemplary operation, with a mill rolling a 2000 kg billet at a rate of 150 metric tons per hour, roll stand 10 would produce a bar having a cross sectional area of 57.4 mm at a delivery speed of 2052.5 mm/sec. The take up speed of roll stand 12 would be 1642 mm/sec.

Switches 11 are arranged to direct successive product lengths exiting from roll stand 10 away from the mill pass line P and along an entry path 14 leading to a welding station 16, and from the welding station along a delivery path 15 back to the mill pass line for continued rolling in the roll stand 12 and all subsequent roll stands (not shown). Alternatively, the switches 11 may be operated to bypass the entry path 14 and to thereby allow discrete product lengths to continue along the pass line P.

A first storage means in the form of a repeater 18 is located along the delivery path 15, and a second storage means, also in the form of a repeater 20 is located along the entry path 14. The repeaters 18, 20 may be of conventional design well known to those skilled in the art.

The welding station 16 includes a welder 22 configured to weld abutting trailing and leading ends of product lengths. The welded joints are deburred by a deburring device 24 before continuing along delivery path 15. The welded joints and adjacent product segments may, if necessary, be reheated in advance of roll stand 12 by an induction heater 26. Driven pinch rolls 28, 30, 32 and 34 are strategically positioned to control the forward movement of the product lengths being processed.

The operation of the apparatus will now be described with reference to FIGS. 2A–2J.

FIG. 2A

A first product length A is being rolled through roll stand 10 at a rate of 150 tons per hour and a speed of 2052.5 mm/sec. The product length A has passed along entry path 14, through the welding station 16 and along delivery path 15, and its front end $A_{FE}$ has arrived at pinch roll unit 34 where it has been temporarily stopped. A first portion of the first product length has begun to accumulate in the form of a loop $A_L$ in repeater 18.

FIG. 2B

The loop $A_L$ in repeater 18 has increased considerably, and the front end $A_{FE}$ of the first product length has now passed through pinch roll unit 34 into roll stand 12. The rolling rate of roll stand 12 is 120 tons per hour, with a take in speed of 1642 m/sec.

FIG. 2C

The loop AL in repeater 18 has reached its maximum. The tail end $A_{TE}$ of the first product length is just clearing roll stand 10, and the front end $B_{FE}$ of the second product length B is approaching roll stand 10.

FIG. 2D

The tail end $A_{TE}$ of the first product length A is now moving into the entry path 14 as the front end $B_{FE}$ of the second product length B enters roll stand 10.

FIG. 2E

The tail end $A_{TE}$ of the first product length A and the front end $B_{FE}$ of the second product length B have arrived at the welding station 16 where they are held stationary in an abutting relationship by pinch roll units 32, 30. Welding of the front and tail ends begins.

FIG. 2F

While welding of the front and tail ends takes place, the loop $A_L$ of the first product length in repeater 18 is gradually depleted, and the second product length B accumulates in a loop BL form in repeater 20.

FIG. 2G

The welded front and tail ends have progressed from the welding station 16 to roll stand 12, and the loop $B_L$ previously accumulated in repeater 20 is now being transferred by the pinch roll units 30, 32 to repeater 18.

FIG. 2H

As transfer of the product loop $B_L$ from repeater 20 to repeater 18 continues, the tail end $B_{TE}$ of the second product length arrives at roll stand 10.

FIG. 2I

As described previously with reference to FIG. 2D, the tail end $B_{TE}$ of the second product length is now moving into the entry path 14 as the front end $C_{FE}$ of a third product length C enters roll stand 10.

FIG. 2J

Welding of the tail end $B_{TE}$ of the second product length to the front end CFE of the third product length has commenced, as described previously with respect to FIG. 2E.

The pinch roll units 28, 30, 32 and 34 are individually driven and thus may be selectively controlled to accelerate, decelerate and stop the successive product lengths in order to effect the above described movements. Although welding is preferably accomplished with the front and tail ends arrested at station 14, alternatively, the pinch roll units 30, 32 could be operated to simply slow the front and tail ends, with the welder 22 being movable at the same speed to effect welding on the fly.

Once a lead product is fed to roll stand 12, uninterrupted rolling continues thereafter in that stand and any subsequent stands throughout the remainder of the mill.

Welding of front and tail ends with reduced cross sectional areas at station 16 can be achieved quickly, with minimum consumption of energy, and with smaller, less expensive welding equipment.

Figure 3:
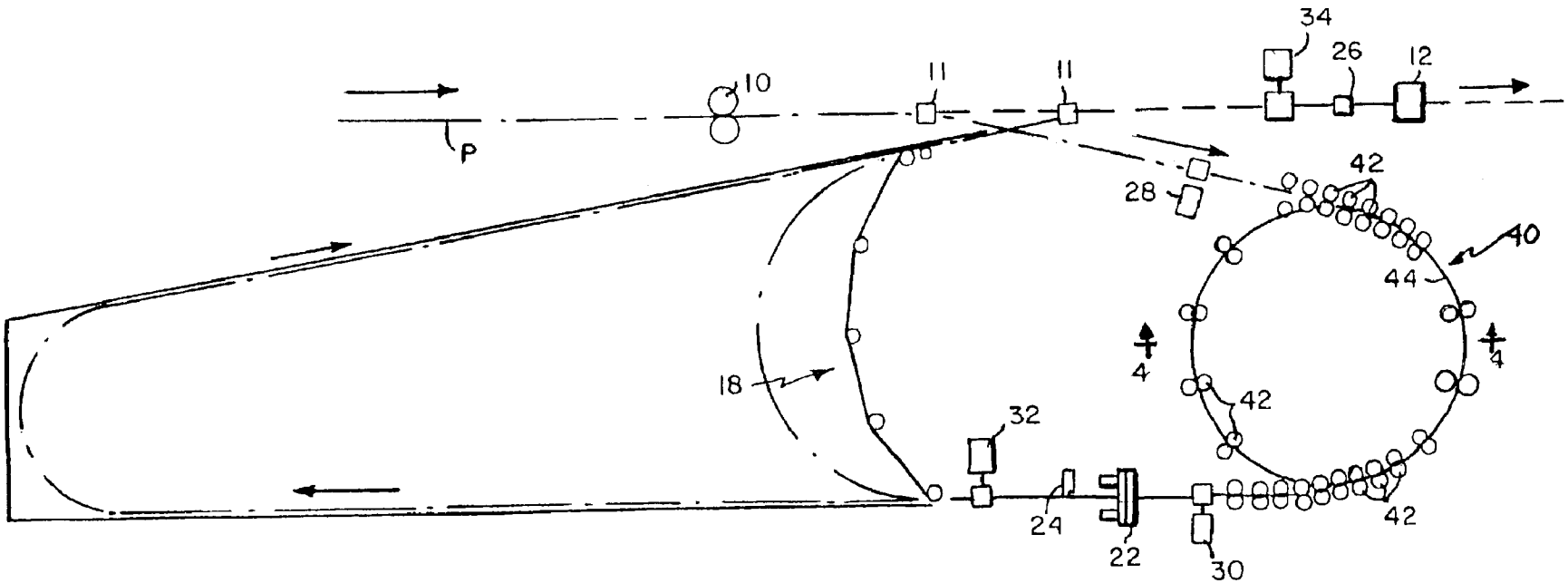
FIG. 3 is a plan view of an alternative embodiment of an apparatus in accordance with the present invention.
Figure 4:
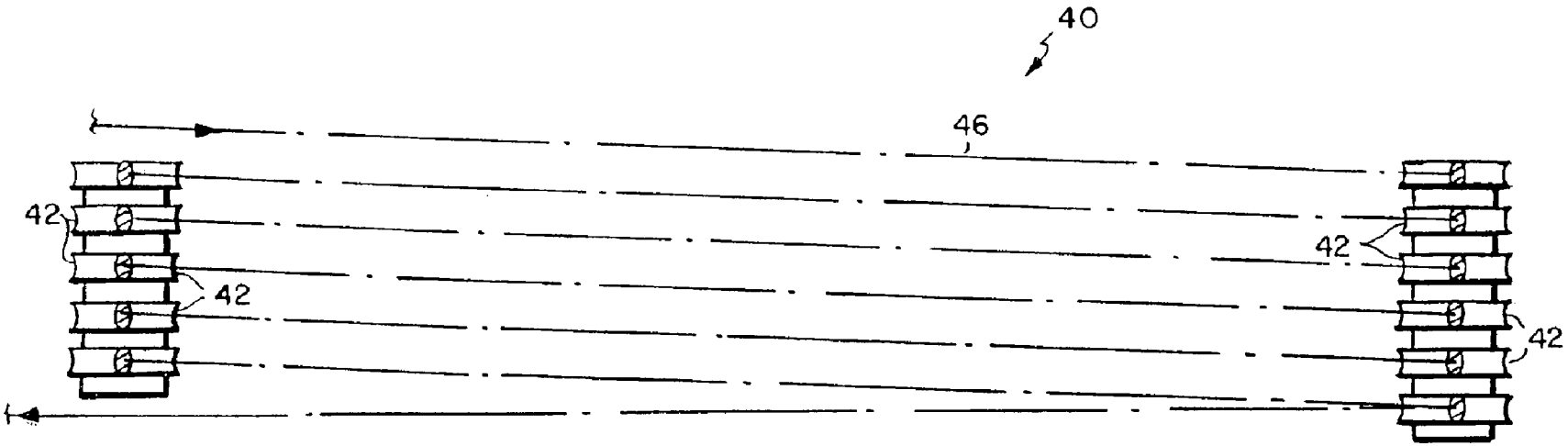
FIG. 4 is an enlarged cross section taken along line 4—4 of FIG. 3 and schematically depicting the stacked storage capacity of the accumulator.

FIGS. 3 and 4 illustrate an alternative embodiment of the invention, where components identical to those of the FIG. 1 embodiment have been identified by the same reference numerals. Here, the repeater 20 of the first embodiment has been replaced by a multilevel accumulator 40.

It will be seen from FIG. 4 that the accumulator comprises vertically stacked pairs of guide rollers 42 arranged around a circular footprint 44. The guide rollers define a helical delivery path 46 configured and dimensioned to provide a product storage capacity comparable to that of the repeater 20 of the FIG. 1 embodiment.

In light of the forgoing it will now be understood by those skilled in the art that the present invention operates to divert successive product lengths exiting from roll stand 10 away from the pass line P and along entry paths 14 (or 46) to the welding station 16, and from the welding station along a delivery path 15 back to the pass line for continued rolling in roll stand 12. Repeater 18 operates in conjunction with pinch roll units 32 and 34 on the delivery side of the welding station to temporarily store a first accumulation of one product length and to arrest or slow the trailing end of that product length at the welding station.

Repeater 20 (or accumulator 44) operates in conjunction with pinch roll units 28 and 30 on the entry side of the welding station to arrest or slow the leading end of the next product length at the welding station, and to temporarily store a second accumulation of that product length.

The first and second product accumulations allow sufficient time for welding the arrested or slowed tail and front ends at the welding station. Thus, a continuous product is fed to roll stand 12 from the discrete product lengths being received from roll stand 10.

The present invention is most advantageously employed to join product lengths having reduced cross sectional areas ranging from about 700–4400 $mm^2$. Here, the fused metal of the welded joints will extend through relatively small lengths on the order of 3–18 meters. Thus, even when billet lengths having dissimilar metallurgy are being welded, scrap losses will be minimized in comparison to those experienced when welding billets prior to rolling.

We claim:

1. A method of rolling discrete product lengths having front and tail ends through successive roll stands arranged on a mill pass line, said method being operable alternatively in first and second modes, said first mode comprising:

operating a first of the roll stands at a delivery speed that exceeds the take up speed of a successive second roll stand;

directing first and second product lengths as they exit from the first roll stand away from the mill pass line along an entry path leading to a welding station positioned laterally with respect to the mill pass line, and from the welding station along a delivery path leading back to the same mill pass line for continued rolling in the second roll stand;

temporarily accumulating a first portion of the first product length along the delivery path while rolling of the first product length is taking place in the second roll stand; retaining the tail end of the first product length at the welding station during a time interval in which the accumulated first portion continues to be rolled in the second roll stand;

retaining the front end of the second product length at the welding station during said time interval, while temporarily accumulating a second portion of the second product length along the entry path;

welding the retained front and tail ends together during said time interval; and releasing the thus welded ends; and said second mode comprising bypassing said entry path and directing said product lengths along said mill pass line from said first roll stand directly to said second roll stand.

2. The method of claim 1 in which the welded ends are subjected to deburring before being rolled in the second roll stand.

3. The method of claims 1 or 2 wherein the product lengths are reheated before being rolled in the second roll stand.

4. The method of claim 1 wherein the said front and tail ends are arrested while being welded at the welding station.

5. An apparatus for rolling discrete product lengths having front and tail ends through successive roll stands arranged on a mill pass line, said apparatus comprising:

first and second roll stands arranged in succession along a mill pass line, the first roll stand being operable at a delivery speed that exceeds the take up speed of the second roll stand;

guide means operable in one mode to direct first and second product lengths exiting successively from said first roll stand directly to said second roll stand, and operable alternatively in another mode to direct first and second product lengths successively exiting from the first roll stand away from the mill pass line along an entry path leading to a welding station positioned laterally with respect to the mill pass line, and from the welding station along a delivery path leading back to the same mill pass line and to the roll stand;

a first storage means for temporarily accumulating a first portion of the first product length along the delivery path while rolling of the first product length takes place in the second roll stand;

retaining means for retaining the tail end of the first product length and the front end of the second product length at the welding station during a time interval in which the accumulated first portion of the first product length continues to be rolled in the second roll stand;

second storage means for temporarily accumulating a second portion of the second product length along the entry path during said time interval; and welding means at said welding station for welding the retained front and tail ends together, whereupon release of the thus welded front and tail ends will permit continued and uninterrupted rolling of the first and second product lengths in the second roll stand.

6. The apparatus as claimed in claim 4 wherein said retaining means is operable to arrest the front and tail ends at said welding station.

7. The apparatus as claimed in claim 4 further comprising means along said delivery path for deburring the welded front and tail ends of said first and second product lengths.

8. The apparatus as claimed in claims 5 or 6 further comprising means for reheating said product lengths in advance of said second roll stand.

9. The apparatus as claimed in claim 5 wherein said first storage means comprises, a repeater for accumulating said first portion in the form of a loop.

10. The apparatus as claimed in claim 5 wherein said arresting means comprises driven pinch roll units on the entry and delivery sides of said welding station.

11. The method of claim 1 wherein said product lengths have cross sectional areas ranging from about 700 to 4400 $mm^2$.

* * * * *